US005287675A

United States Patent [19]

McGee

[11] Patent Number: 5,287,675

[45] Date of Patent: Feb. 22, 1994

[54] WALL STUD ASSEMBLY

[75] Inventor: Wayne R. McGee, Chesterfield, Mo.

[73] Assignee: Porta-Fab Corporation, Chesterfield, Mo.

[21] Appl. No.: 772,338

[22] Filed: Oct. 7, 1991

[51] Int. Cl.[5] ..... E04B 2/60

[52] U.S. Cl. ..... 52/770; 52/265; 52/267; 52/270; 52/281; 52/468; 52/731.9; 52/772

[58] Field of Search ..... 52/263, 265, 267, 770, 52/772, 270, 272, 468, 281, 282, 461, 464, 731.7, 731.8, 731.9

[56] References Cited

U.S. PATENT DOCUMENTS 3,066,770 12/1962 Millard et al. ..... 52/272
3,073,420 1/1963 Olsen ..... 52/772
3,339,324 9/1967 Stackhouse ..... 52/464
3,449,877 6/1969 Beckman ..... 52/770

*Primary Examiner*—Michael Safavi
*Attorney, Agent, or Firm*—Rogers, Howell & Haferkamp

[57] ABSTRACT

A wall stud assembly for a wall of an in-plant/portable building wherein the wall includes interfitting wall stud assemblies and wall panels is disclosed. The stud assembly comprises first and second stud members, each of which is generally U-shaped in cross-section and has an open side and a base side. In addition, a strut is positioned longitudinally between the first and second stud members and affixed to the base sides of the stud members, with the open sides of the stud members facing outwardly. Each stud member has laterally extending flanges. The flanges of one stud member are in spaced generally parallel relation to the flanges of the other stud member to sandwich a wall panel therebetween.

13 Claims, 2 Drawing Sheets

WALL STUD ASSEMBLY

BACKGROUND OF THE INVENTION

This invention relates to a wall stud assembly and more particularly to a wall stud assembly for a portable-/in-plant building.

The buildings of the type to which the wall stud assembly of this invention relates are prefabricated and ready for assembly at the building site. Such buildings include in-plant offices, guard houses, food service buildings, control rooms, toll booths, parking lot booths, noise control buildings, clean rooms, and the like. Such buildings are formed from load-bearing wall structures as opposed to mere partitions. These portable buildings must be of quality construction, strong and durable. They should be energy efficient, have good sound control and low maintenance. Other characteristics of such buildings are that they must be relatively easy to assemble at the job site and easily disassembled for moving to a different location if desired. They should also be economical.

Such building structures are well-known in the art as are wall studs for use with such building structures. Typically, such wall studs are of steel or extruded aluminum and have side recesses for receiving the side edges of wall panels to form the walls of the building.

One such prior art wall stud has first and second stud members, each of which is generally U-shaped in cross-section with a base and opposing sides forming an open side and a base side of each stud member. Each of such stud members has laterally extending flanges extending outwardly from the side walls at the open side. The base sides of the stud members are affixed in surface engagement with the open sides of the stud members facing outwardly, therefore to sandwich a wall panel between the outwardly extending flanges of the stud members. The base sides are affixed to each other by means of anchoring screws which extend through the base sides of the stud members. Thus, the fasteners or screws are oriented along a single longitudinal line.

Such assemblies suffer certain drawbacks, however. Fur example, such assemblies are not as strong as desired. Thus, in order to withstand typical loads, the stud assemblies are generally limited to twelve feet in height. Moreover, such assemblies are adapted to walls of limited thickness, generally about 3 inches thick, while in certain situations thicker walls (such as 4 to 5 inches thick) are desired for temperature or sound insulation, ventilation passageways or other reasons. Although the width of the sides of the U-shaped stud members may be increased thereby to deepen the U-shaped cross-sectional to accommodate thicker walls, it has been found that retooling costs to effect such changes increases the cost of the stud assembly significantly. In addition, it does not adequately address the desire for stronger stud assemblies.

SUMMARY OF THE INVENTION

The present invention is an improvement to such prior art wall stud assemblies. It provides improved strength and stability under load, yet maintains ease of assembly and low cost. In accordance with the present invention, a strut is provided longitudinally between the first and second stud members and affixed to the base sides of the stud members. This stud assembly has exceptional rigidity and strength to carry the transverse, lateral, and vertical loads required by the building structure.

DESCRIPTION OF THE PREFERRED EMBODIMENT

Figure 1:
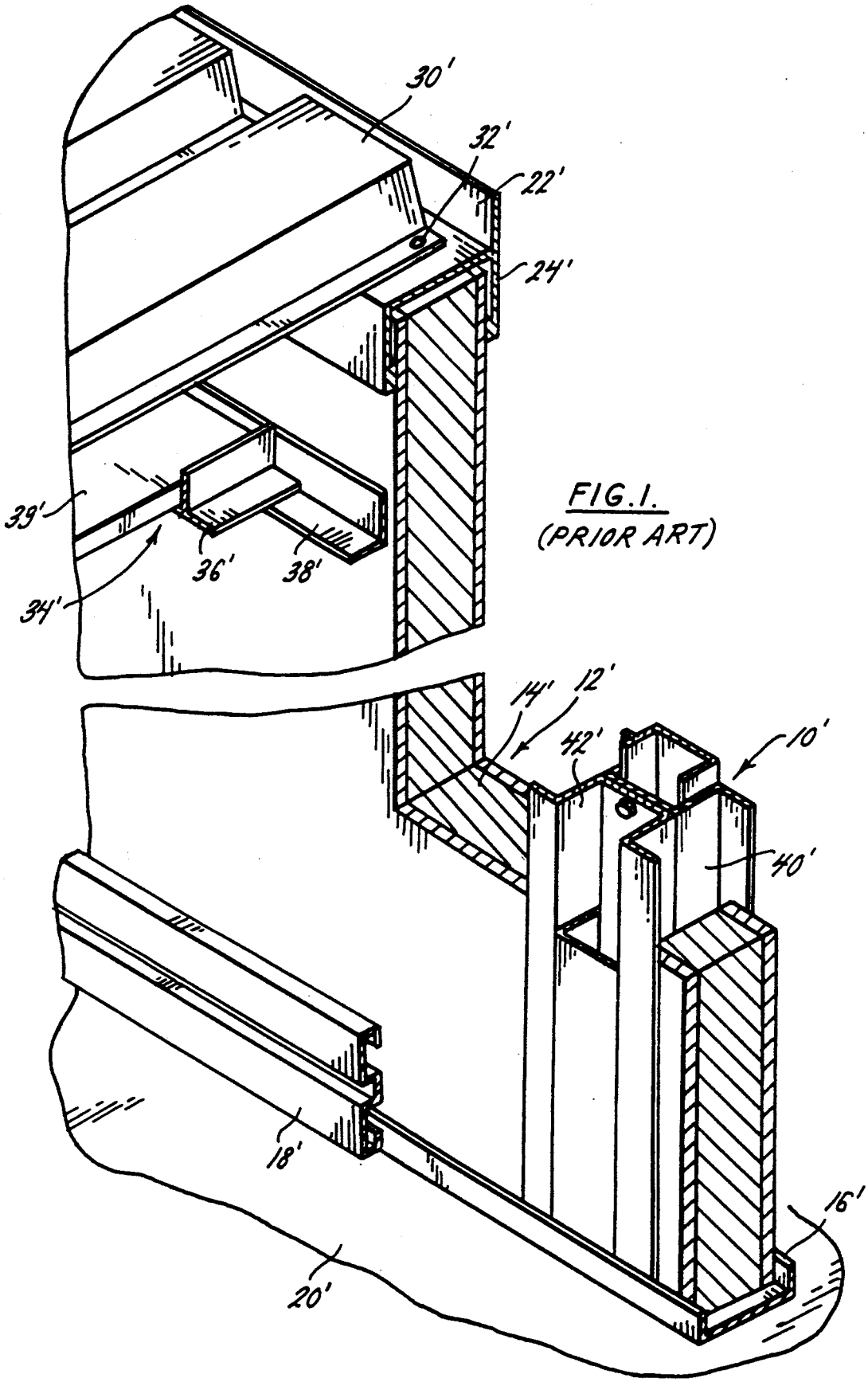
FIG. 1. (PRIOR ART)
FIG. 1 is a partial perspective view of a prior art wall stud assembly in its structural environment, with component parts of the assembly and the environment shown in section.

With reference to the drawings, FIG. 1 shows a wall stud assembly 10' of the prior art as described above. Such assembly is for use in a wall 12' of a portable or in-plant building of the type previously described. The wall 12' also includes panels 14', a floor track 16' at the base of the stud assembly 10' and the panels 14', and a vinyl base 18' that extends along the base of the wall at the floor 20'. A cornice mold angle 22' is located at the top of the wall and has a downwardly facing U-shaped channel portion 24' into which the tops of the panels 14' extend. A corrugated dust cover 30' rests on top of the cornice mold and is secured thereto by screws or rivets 32'. A lay-in ceiling framework 34' comprised of angle members 36' and 38' is supported beneath the cornice mold and dust cover, and supports suitable ceiling tile 39' to comprise the ceiling for the room.

The wall panels 14' may be of any suitable thickness, but are conventionally on the order of about 3 inches thick. The panels may be structured in a variety of ways suitable for pre-fabricated building structures of the type to which the wall stud of the present invention relates. For example, the wall panel may have a honeycomb core with vinyl covered handboard on both sides. As another example, the wall panel may have a non-combustible insulating core, such as of polystyrene foam, with gypsum outer panels laminated thereto.

The prior art wall stud assembly 10' of FIG. 1 comprises first and second stud members 40' and 42'. Each stud member is of generally U-shaped cross-section with the open sides of the "U" facing away from each other (outwardly) and the base sides oriented inwardly, that is, with the bases directed inwardly and in surface engagement with each other.

Figure 2:
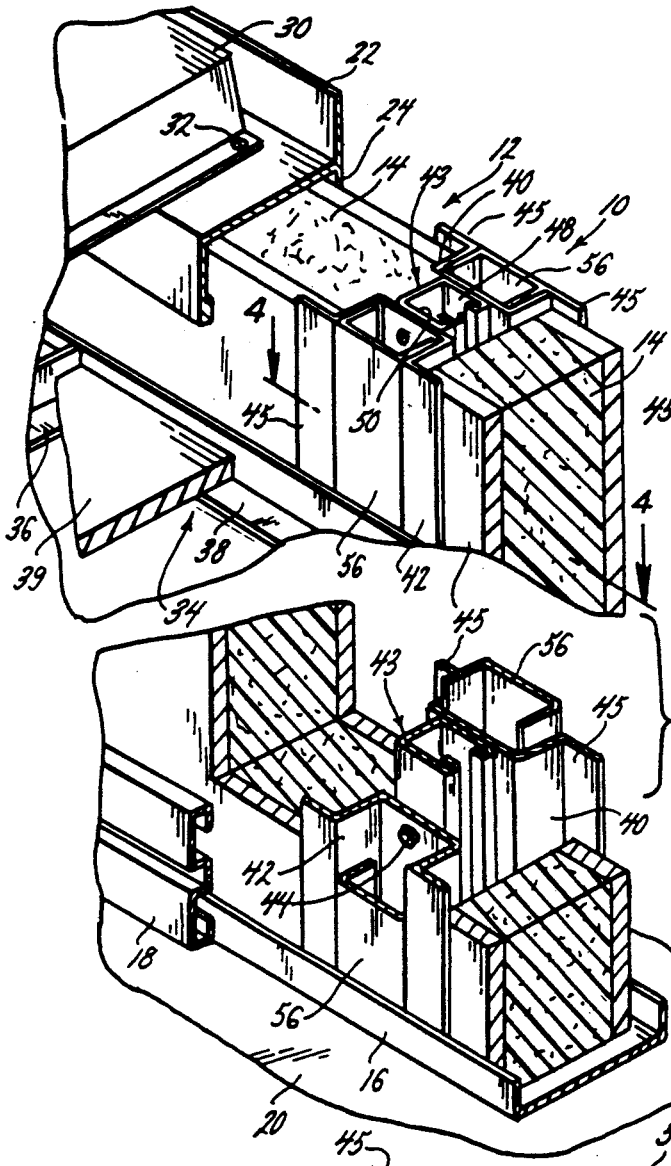
FIG. 2 is a partial perspective view of a wall stud assembly of this invention in its structural environment, with component parts of the assembly and the environment shown in section.
Figure 3:
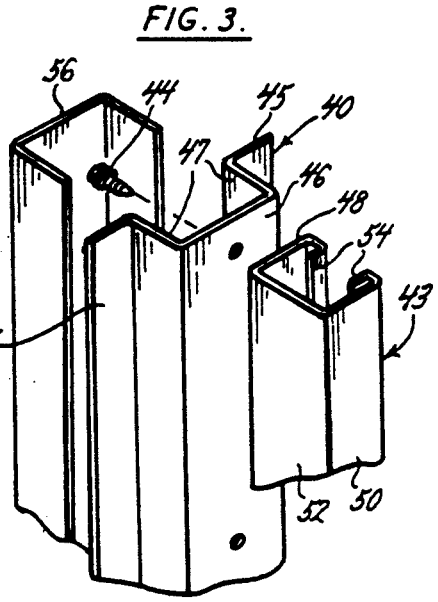
FIG. 3 is a partial exploded view of a stud member, cover therefor strut and fastener of the assembly of FIG. 2, shown in perspective.
Figure 4:
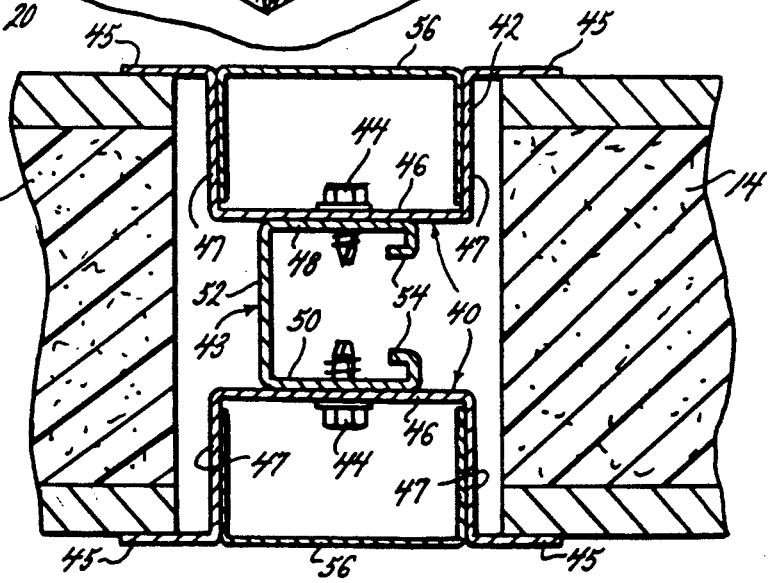
FIG. 4 is a partial plan view of the assembly of FIG. 2 in its structural environment.

FIGS. 2-4 show the wall stud assembly 10 of the present invention. The reference numerals labeling the environment of the present invention correspond to those used in describing the prior art environment in FIG. 1, except that the numerals used with respect to the environment of the present invention are not followed by a prime (′). The wall stud assembly of the present invention may be employed in the environment as just described with respect to the prior art wall stud assembly of FIG. 1, except that the wall study assembly of the present invention is adapted to accommodate walls of greater and various thicknesses, such as about 4 inches to 5 inches or more, for example, about 4⅝ inches thick. As with the prior art stud assembly of FIG. 1, the stud assembly 10 of the present invention comprises first and second stud members 40 and 42 (corresponding to stud members 40' and 42' of the prior art assembly), each of which is of generally U-shaped cross-section with the open sides of the "U" facing away from each other (outwardly) and the base sides oriented inwardly. However, the base sides are not in surface engagement in the present invention, but are in spaced generally parallel relation.

A strut 43 is positioned longitudinally between the first and second stud members and affixed by means of metal screws 44 to the base sides of the stud members, with the open sides of the stud members facing outwardly. Each stud member has laterally extending flanges 45. The flanges of one stud member are in spaced parallel relation to the flanges of the other stud member thereby to sandwich wall panels 14 therebetween.

Accordingly, each stud member 40 is generally U-shaped in cross-section as shown, having a base or back wall 45 parallel to the plane of the room wall, and side walls 47 extending forwardly of the base or back wall at right angles thereto. The forward edges of the side walls 47 have flanges 45 extending perpendicularly to the side walls and outwardly of the U-shaped cross-section.

The strut 43 situated longitudinally between the base walls of the stud members has first and second surfaces 48 and 50 in spaced generally parallel relation to each other and has a means for maintaining the first and second surfaces in spaced generally parallel relation. For example, as shown in the figures, the strut may be generally U-shaped in cross-section with first and second side surfaces 48 and 50 and base wall 52. Thus, base wall 52 maintains the first and second surfaces 48 and 50 in spaced generally parallel relation. The rigidity and/or stiffness of the side walls of the strut may be aided by means of in-turned lips 54 extending from the forward edges of the first and second side surfaces of the strut.

The strut may be formed of steel approximately 3/32 inches thick. The width of the strut (i.e., the distance between the first and second side surfaces) may be selected according to the wall thickness. Where P-1000 unistrut from Unistrut of Wayne, Mich. is employed, the approximately 1⅝ inch width of the strut produces a stud assembly suited to a wall of 4⅝ inch thickness as opposed to the three inches of thickness accommodated without the strut.

The first and second side surfaces of the strut are in surface engagement with the respective base sides of the first and second stud members, and are affixed thereto by fastening means such as sheet metal screws 44, which extend through suitable openings in the mating first and second surfaces and respective base sides of the stud members, thereby to secure the stud members to the strut. The open sides of each stud member may be covered with removable stud covers 56, which may be maintained in position by frictional engagement within the stud member.

Each of the stud members 40 and 42, and the stud cover 56 can be formed by roll forming or extrusion and may be of metal or other suitable material for supporting the vertical loads of the building structure. Preferably, however, the stud members are formed from 12 or 16 gauge steel and the stud cover from 24 gauge steel. Moreover, it has been found preferable to locate the screws 44 approximately 18 inches apart, instead of the 24 inches spacing employed in the prior art configuration shown in FIG. 1.

In view of the relatively low cost of struts as described herein, it has been found that employing the combination of stud members and strut as described above is less expensive than employing stud members of deeper U-shaped cross-section. Not only that but, surprisingly, it has been found that the wall stud assembly of this invention provides significantly greater structural support than provided by stud members without the strut or the strut without the stud members, and even significantly greater support than the sum of the support provided by the individual components. This superior strength is particularly significant in that it is used in in-plant/portable buildings which must support a load such as a roof, as opposed to a partition system which merely partitions space and which need provide little or no structural vertical support. Moreover, the stud assemblies of this invention have been formed to have less tendency to bow under vertical or lateral loads than do the prior art assemblies described. Thus, whereas prior art stud assemblies in typical circumstances have been limited in height to twelve feet, the greater strength of the stud assemblies of this invention permit stud assemblies of fifteen feet in height.

Other advantages derived from the practice of this invention will be apparent from the following description and example.

EXAMPLE

A 12 foot section of P-1000 unistrut from Unistrut of Wayne, Mich., was obtained. According to the literature, a 12 foot section of such unistrut (without a lateral load applied to the unistrut) can bear an axial load of 2200 lbs. per square foot. A 12 foot tall stud assembly (formed of 16 gauge steel with 24 gauge steel covers) as shown in FIG. 1 was tested and found to be capable of bearing an axial load of 2300 lbs. (with a lateral load applied to the stud assembly of 5 PSF). A stud assembly was formed by placing the unistrut between the stud members as shown in FIGS. 2–4 and tested for strength. This stud assembly of this invention was found to be capable of bearing an axial load of 5500 lbs. (with a load applied to the stud assembly of 5 PSF). Without a lateral load, the 12 foot stud assembly of FIG. 1 was found to hold an axial load of about 6000 lbs. The assembly of FIGS. 2–4 was found to withstand an axial load of about 9970 lbs.

While the present invention has been described by reference to specific embodiments, it should be understood that modifications and variations of the invention may be constructed without departing from the scope of the invention defined in the following claims.

What is claimed is:

1. In a vertical column between and connecting vertical wall panels of a wall wherein the wall includes wall panels and interfitting wall stud assemblies, a wall stud assembly comprising:

first and second generally parallel, elongate, vertical stud members, each of which being generally U-shaped in cross-section and having an open side and an opposite base side; and an elongate strut positioned vertically between and generally parallel to the first and second stud members and affixed to the base sides of the stud members, with the open sides of the stud members facing outwardly;

each stud member having first and second laterally extending flanges, the first flanges of the stud members being in spaced-apart generally parallel relation to form jaws of a clamp pinching and sandwiching a vertical edge of a first wall panel extending therebetween, and the second flanges of the stud members being in spaced-apart, generally parallel relation to form jaws of a clamp pinching and sandwiching a vertical edge of a second wall panel extending therebetween, the strut being located wholly between the vertical edges of the first and second wall panels.

2. A wall stud assembly as set forth in claim 1 wherein the strut has first and second surfaces in spaced apart generally parallel relation to each other and means for maintaining the first and second surfaces in spaced generally parallel relation, the first and second surfaces in surface engagement with and being affixed to the respective base sides of the first and second stud members.

3. A wall stud assembly as set forth in claim 1 further comprising a removable stud cover over the open side of each of the stud members, and means for removably mounting the stud covers to the stud members.

4. The wall stud assembly as set forth in claim 1 wherein the first flange of each stud member extends from a first side wall of a pair of side walls extending forward from the base side of the stud member and the second flange extends from a second side wall of the pair.

5. A stud assembly as set forth in claim 4 wherein the stud members are positioned with the first side walls of the stud members in coplanar orientation and the second side walls of the stud members in coplanar orientation.

6. A wall stud assembly as set forth in claim 1 wherein each of the pair of first flanges and the pair of second flanges is configured to retain a wall panel therebetween by positioning the wall panel between the pair of flanges of the respective stud members and affixing the stud members to the strut positioned between the stud members.

7. A wall comprising a plurality of vertical wall panels and a vertically extending walls stud assembly between adjacent wall panels, the wall stud assembly comprising:

first and second generally parallel, elongate, vertical stud members, each of which being generally U-shaped in cross-section and having an open side and an opposite base side; and an elongate strut positioned longitudinally vertically between and generally parallel to the first and second stud members and affixed to the base sides of the stud members, with the open sides of the stud members facing outwardly;

each stud member having a first and a second laterally extending flange, the first laterally extending flange of the first stud member being in spaced-apart generally parallel relation to the first laterally extending flange of the second stud member to form jaws of a clamp pinching and sandwiching a vertical edge of a first wall panel therebetween, and the second laterally extending flanges of the first and second stud members being in spaced-apart, generally parallel relation to form jaws of a clamp pinching and sandwiching a vertical edge of a second wall panel therebetween the strut being located wholly between the vertical edges of the first and second wall panels.

8. A wall stud assembly as set forth in claim 7 wherein the strut has first and second surfaces in spaced generally parallel relation to each other and means for maintaining the first and second surfaces in spaced generally parallel relation, the first and second surfaces in surface engagement with and being affixed to the respective base sides of the first and second stud members.

9. In a vertical column between and connecting vertical wall panels of a wall wherein the wall includes wall panels and interfitting wall stud assemblies, a wall stud assembly comprising:

first and second generally parallel, elongate, vertical stud members, each of which being generally U-shaped in cross-section and having an open side and an opposite base side; and an elongate strut positioned vertically between and generally parallel to the first and second stud members and affixed to the base sides of the stud members, with the open sides of the stud members facing outwardly, the strut being generally U-shaped in cross-section and comprising first and second side walls in spaced-apart generally parallel relation to each other and a base wall, the first and second side walls being affixed to the base sides of the first and second stud members, respectively;

each stud member having first and second laterally extending flanges, the first flanges of the stud members being in spaced-apart generally parallel relation sandwiching a vertical edge of a first wall panel therebetween, and the second flanges of the stud members being in spaced-apart, generally parallel relation sandwiching a vertical edge of a second wall panel therebetween.

10. A wall stud assembly as set forth in claim 9 wherein the first and second side walls of the strut each has an edge oriented away from and generally parallel to the base wall of the strut and a turned-in lip extending from the edge.

11. In a vertical column between and connecting vertical wall panels of a wall wherein the wall includes wall panels and interfitting wall stud assemblies, a wall stud assembly comprising:

first and second generally parallel, elongate, vertical stud members, each of which being generally U-shaped in cross-section and having an open side and an opposite base side; and an elongate, generally U-shaped strut positioned vertically between and generally parallel to the first and second stud members and affixed to the base sides of the stud members, with the open sides of the stud members facing outwardly, the strut having first and second surfaces in spaced-apart, generally parallel relation to each other and means for maintaining the first and second surfaces in spaced-apart, generally parallel relation, the first and second surfaces in surface engagement with and being affixed to the respective base sides of the first and second stud members;

each stud member having first and second laterally extending flanges, the first flanges of the stud members being in spaced-apart generally parallel relation sandwiching a vertical edge of a first wall panel therebetween, and the second flanges of the stud members being in spaced-apart, generally parallel relation sandwiching a vertical edge of a second wall panel therebetween.

12. A wall comprising a plurality of vertical wall panels and a vertically extending wall stud assembly between adjacent wall panels, the wall stud assembly comprising:

first and second generally parallel, elongate, vertical stud members, each of which being generally U-shaped in cross-section and having an open side and an opposite base side; and an elongate strut positioned longitudinally vertically between and generally parallel to the first and second stud members and affixed to the base sides of the stud members, with the open sides of the stud members facing outwardly, the strut being generally U-shaped in cross-section and comprising first and second side walls in spaced-apart, generally parallel relation to each other and a base wall, the first and second side walls being affixed to the base sides of the first and second stud members, respectively;

each stud member having first and second laterally extending flange, the first laterally extending flange of the first stud member being in spaced-apart generally parallel relation to the first laterally extending flange of the second stud member sandwiching a vertical edge of a first wall panel therebetween, and the second laterally extending flanges of the first and second stud members being in spaced-art, generally parallel relation sandwiching a vertical edge of a second wall panel therebetween.

13. A wall comprising a plurality of vertical wall panels and a vertically extending wall stud assembly between adjacent wall panels, the wall stud assembly comprising:

first and second generally parallel, elongate, vertical stud members, each of which being generally U-shaped in cross-section and having an open side and an opposite base side; and an elongate, generally U-shaped strut positioned longitudinally vertically between and generally parallel to the first and second stud members and affixed to the base sides of the stud members, with the open sides of the stud members facing outwardly, the strut having first and second surfaces in spaced-apart, generally parallel relation to each other and means for maintaining the first and second surfaces in spaced-apart, generally parallel relation, the first and second surfaces in surface engagement with and being affixed to the respective base sides of the first and second stud members;

each stud member having first and second laterally extending flange, the first laterally extending flange of the first stud member being in spaced-apart generally parallel relation to the first laterally extending flange of the second stud member sandwiching a vertical edge of a first wall panel therebetween, and the second laterally extending flanges of the first and second stud members being in spaced-apart, generally parallel relation sandwiching a vertical edge of a second wall panel therebetween.

* * * * *